US009506133B2

(12) United States Patent
Heinrich et al.

(10) Patent No.: US 9,506,133 B2
(45) Date of Patent: Nov. 29, 2016

(54) BULK METALLIC GLASS FORMING ALLOY

(71) Applicant: UNIVERSITAT DES SAARLANDES, Saarbrucken (DE)

(72) Inventors: Jochen Heinrich, Saarbrucken (DE); Ralf Busch, Saarbrucken (DE)

(73) Assignee: UNIVERSITAT DES SAARLANDES, Saarbrucken (DE)

( * ) Notice: Subject to any disclaimer, the term of this patent is extended or adjusted under 35 U.S.C. 154(b) by 268 days.

(21) Appl. No.: 14/358,246

(22) PCT Filed: Nov. 22, 2012

(86) PCT No.: PCT/EP2012/004836

§ 371 (c)(1),
(2) Date: May 15, 2014

(87) PCT Pub. No.: WO2013/075829

PCT Pub. Date: May 30, 2013

(65) Prior Publication Data

US 2014/0311630 A1 Oct. 23, 2014

(30) Foreign Application Priority Data

Nov. 24, 2011 (EP) ..... 11009331

(51) Int. Cl.

| | |
|---|---|
| ***C22C 1/02*** | (2006.01) |
| ***C22C 45/10*** | (2006.01) |
| ***C22C 1/00*** | (2006.01) |
| ***C22C 16/00*** | (2006.01) |

(52) U.S. Cl.
CPC ..... *C22C 45/10* (2013.01); *C22C 1/002* (2013.01); *C22C 16/00* (2013.01)

(58) Field of Classification Search
None
See application file for complete search history.

(56) References Cited

U.S. PATENT DOCUMENTS

| | | | | |
|---|---|---|---|---|
| 5,797,443 | A * | 8/1998 | Lin | B22D 46/00 148/403 |
| 7,153,376 | B2 * | 12/2006 | Wolter | C22C 45/10 148/403 |
| 8,906,172 | B2 * | 12/2014 | Gong | C22C 1/002 148/403 |

FOREIGN PATENT DOCUMENTS

| | | |
|---|---|---|
| CN | 1754974 A | 4/2006 |
| CN | 102041462 A | 5/2011 |
| JP | 2003-239051 A | 8/2003 |
| WO | WO 2011/050695 | 5/2011 |

OTHER PUBLICATIONS

European Search Report dated May 24, 2012 for Application No. EP 11 009 331.7.
International Search Report and Written Opinion dated Feb. 5, 2013 for Application No. PCT/EP2012/004836.

(Continued)

*Primary Examiner* — George Wyszomierski
(74) *Attorney, Agent, or Firm* — Frost Brown Todd LLC

(57) ABSTRACT

A bulk metallic glass forming alloy having the following composition x(aZr bHf cM dNb eO) yCu zAl and its preparation from an alloy L=(aZr bHf cM dNb eO), Cu, and Al as well as the use thereof is described.

5 Claims, 1 Drawing Sheet

Differential scanning calorimetry measurement of a reference of rod-shape with a diameter of 5 mm and a die-cast product; the inset shows the X-ray diffraction pattern of the casting

AMZ4 = $yL_{com}$ xCu zAl wherein x = 71.9 wt%, y = 24.4 wt%, and z = 3.7 wt%

(56) References Cited

OTHER PUBLICATIONS

International Preliminary Report on Patentability dated May 27, 2014 for Application No. PCT/EP2012/004836.
Das, J., et al., "Designing bulk metallic glass and glass matrix composites in martensitic alloys, " Journal of Alloys and Compounds, 483 (2009), pp. 97-101.
Fan, J.T., et al., "Effect of microstructures on the compressive deformation and fracture behaviors of $Zr_{47}Cu_{46}Al_7$ bulk metallic glass composites," Journal of Non-Crystalline Solids, 353 (2007) pp. 4707-4717.
Chinese First Office Action dated Sep. 6, 2015 for Application No. 201280057584.5.
Cheney, J. et al, "Evaluation of glass-forming ability in metals using multi-model techniques", Journal of Alloys and Compounds, 483 (2009), pp. 97-101.
Sun, Y.F., et al, "Effect of Nb content on the microstructure and mechanical properties of Zr—Cu—Ni—Al—Nb glass forming alloys." Journal of Alloys and Compounds, 403(2005), pp.

* cited by examiner

Differential scanning calorimetry measurement of a reference of rod-shape with a diameter of 5 mm and a die-cast product; the inset shows the X-ray diffraction pattern of the casting
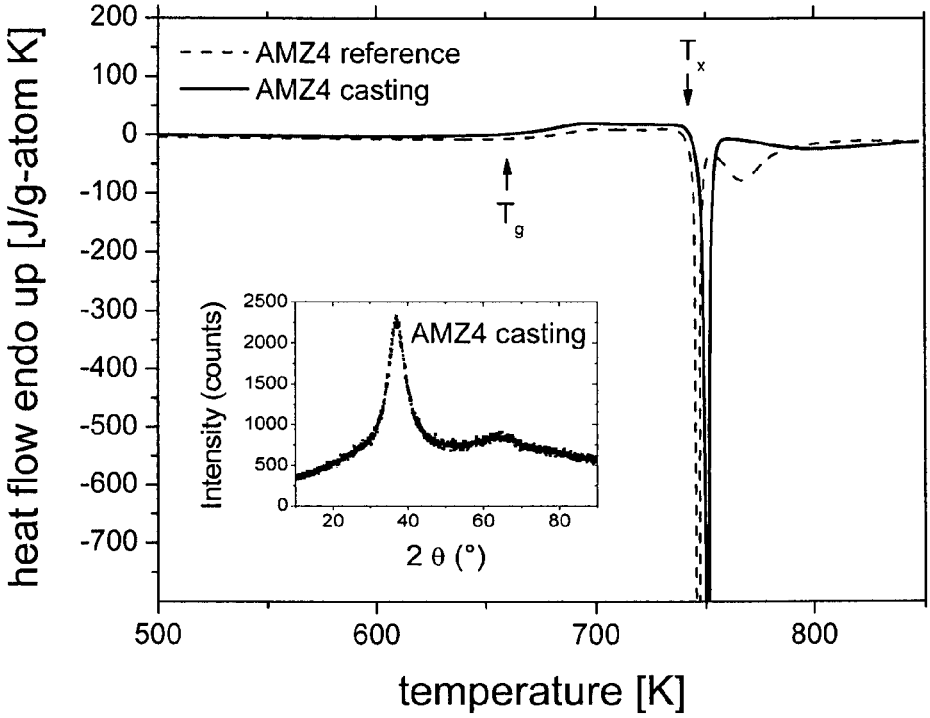
AMZ4 = $yL_{com}$ xCu zAl wherein x = 71.9 wt%, y = 24.4 wt%, and z = 3.7 wt%

BULK METALLIC GLASS FORMING ALLOY

FIELD OF THE INVENTION

The present invention relates to a bulk metallic glass forming alloy and the preparation thereof.

BACKGROUND OF THE INVENTION

Due to their amorphous nature involving long range disorder and short range order, metallic glasses formed from glass forming alloys generally have excellent physical, chemical and mechanical properties, such as high strength, high hardness, high wear resistance, high corrosion resistance, high elasticity, high electrical resistance, good superconductivity, and low magnetic loss, which makes them suited for use in a wide range of fields, e.g. in the mechanics, medical equipments, electrics, and military industries.

Of particular interest are bulk glass forming alloys which are a group of multi-component metallic alloys that show exceptionally high resistance to crystallization in the undercooled liquid state. They usually can be vitrified at cooling rates of less than 10 Kelvin per second.

Some of these alloys are so-called "quasi-ternary" alloys, the components of which may be selected from one or more metals of the group IVB (or 4) and one or more metals of the groups VIIIB and IB (or 8-11) in conjunction with one or more metals selected from the groups IIA, IIIB, IIIA, IVA, VA, VB and VIB (or 2, 3, 5, 6, 13 and 14).

For the preparation of these alloys, the metals are usually employed in very pure form containing as little oxygen as possible which adds to the manufacturing costs.

The present invention seeks to find a method of lowering the manufacturing costs without compromising the physical, chemical and mechanical properties of the bulk metallic glass produced.

SUMMARY OF THE INVENTION

The present invention relates to a bulk metallic glass forming alloy having the following composition:

$$x(a\mathrm{Zr}\ b\mathrm{Hf}\ c\mathrm{M}\ d\mathrm{Nb}\ e\mathrm{O})y\mathrm{Cu}\ z\mathrm{Al}$$

wherein

M=Fe and/or Cr, x=70.5-73.5 wt %; y=23.3-25.5 wt %; z=3.4-4.2 wt %;

with x+y+z=100%; and a=91.0-98.0 wt %; b=0.02-4.5 wt %; c=0.02-0.2 wt %; d=1.8-3.2 wt %; e=0.02-0.18 wt % with a+b+c+d+e=100 wt %, with unavoidable trace impurities, such as hydrogen, nitrogen and carbon, not being considered.

This may be rewritten as $$x\mathrm{L}\ y\mathrm{Cu}z\mathrm{Al}$$

wherein

L=aZr bHf cM dNb eO and x, y, z , a, b, c, d, e and M are as defined above.

Furthermore, the present invention relates to a method of preparing the above alloy wherein 70.5-73.5 wt % of a pre-formed alloy L=aZr bHf cM dNb eO (wherein a, b, c, d, e and M are defined above), 23.3-25.5 wt % of Cu and 3.4-4.2 wt % of Al are provided and, under an inert gas atmosphere, are heated to a temperature of higher than the liquidus temperature of the pre-formed alloy L, homogenized at a temperature of about 50 to about 100 K above the liquidus temperature of the resulting alloy and cast into a metallic mold.

BRIEF DESCRIPTION OF THE DRAWING

FIG. 1 shows a differential scanning calorimetry measurement of a reference of rod-shape with a diameter of 5 mm and a die-cast product; the inset shows the X-ray diffraction pattern of the casting.

DETAILED DESCRIPTION

It was surprisingly discovered that a bulk metallic glass having excellent mechanical properties can be prepared by using a pre-formed alloy aZr bHf cM dNb eO wherein M=Fe and/or Cr and a=91.0-98.0 wt %; b=0.02-4.5 wt %; c=0.02-0.2 wt %; d=1.8-3.2 wt %; e=0.02-0.18 wt % and a+b+c+d+e=100 wt % (this alloy is termed "L" herein) in an amount of 70.5-73.5 % by weight in conjunction with 23.3-25.5 wt % of Cu and 3.4-4.2 wt % of Al.

Based on at %, the formula $$x(a\mathrm{Zr}\ b\mathrm{Hf}\ c\mathrm{M}\ d\mathrm{Nb}\ e\mathrm{O})y\mathrm{Cu}\ z\mathrm{Al}$$

wherein x, a, b, c, d, e, y, and z areas defined above, can also be expressed as:

$$(\mathrm{Zr}_{a'}\mathrm{Hf}_{b'}\mathrm{M}_{c'}\mathrm{Nb}_{d'}\mathrm{O}_{e'})_{x'}\mathrm{Cu}_{y'}\mathrm{Al}_{z'}$$

wherein x'=59.8-62.0 at %, y'=27.8-29.8 at %, z'=9.5-11.3 at %, and a'=92.1-97.2 at %, b'=0.01-2.3 at %, c'=0.03-0.3 at %, d'=1.8-3.1 at %, e'=0.1-1.1 at %.

The molar mass of L ($=\mathrm{Zr}_{a'}\mathrm{Hf}_{b'}\mathrm{M}_{c'}\mathrm{Nb}_{d'}\mathrm{O}_{e'}$) thus varies from 86.836-89.523 g/mol, depending on its exact composition.

Preferably, L corresponds to the commercially available industrial grade zirconium-based alloy R60705 which is a relatively inexpensive raw material.

A typical composition of R60705 is (in wt %):

Zr+Hf min. 95.5

Hf max. 4.5

Fe+Cr max. 0.20

Nb 2.0-3.0

O max. 0.18

Traces:

C max. 0.05

N max. 0.025

H max. 0.005

For convenience, R60705 will be called hereinafter "$\mathrm{L}_{com}$".

When $\mathrm{L}_{com}$ is employed as the alloy L of the invention, x is preferably 71.9 wt %, y is preferably 24.4 wt %, and z is preferably 3.7 wt %.

Surprisingly, the relatively high amount of oxygen which may be present in the alloy of the invention has proven to be of no harm to the properties of the alloy. This is in stark contrast to what had to be expected from the prior art.

Furthermore, the present alloy does neither contain Be nor Ni. This is highly advantageous, since the former is toxic and the latter can provoke severe allergies.

The Cu and Al used in the present invention are preferably of very high purity (≥9.9 wt %).

It should be noted that the generally amorphous bulk metallic glasses prepared from the present alloy may contain some isolated fractions of a crystalline phase which, however, does not significantly alter their properties.

For the preparation of the alloy of the invention, the surface of the raw material components (L, Cu, Al) which are usually employed in the form of rods or spheres of varying sizes is at first cleaned by an ultrasound or etching process depending on the contamination of the surfaces.

Then the desired amounts according to the above formula are weighed to 0.1% and introduced into a crucible made e.g. of carbon.

The subsequent procedures are all conducted under inert gas (preferably Ar) atmosphere.

The crucible is placed into an induction furnace which is then thoroughly evacuated (e.g. to $10^{-3}$ mbar) and filled with inert gas, preferably Ar (minimum purity 4.8 (=99.998 at %)) to atmospheric pressure.

Next, the temperature in the furnace is raised above (e.g. about 50 to about 100 K above) the melting temperature of the component with the highest melting point, the pre-formed alloy L, which is about 1900-2000° C. (In practice, the power of the furnace is raised to the point where the component with the highest melting point, the alloy L, is present in the liquid state. This is controlled visually or by means of a pyrometer.)

Then, the melt is homogenized by means of the alternating high-frequency induction field of the furnace which causes a strong convection and thus mixing. During homogenization, the temperature is allowed to cool down to somewhat (e.g. about 50 to about 100 K) above the liquidus temperature of the resulting alloy which is in the order of about 1000° C. (In practice, this is again achieved by controlling the power of the furnace accordingly.)

The time period for a thorough homogenization depends on the amount of the metals employed and is in the range of 30-120 sec. The presence of a fully homogenized liquid alloy can be confirmed by microstructural analyses with electron microscopy and energy dispersive X-ray spectroscopy.

While still under atmospheric inert gas pressure, the homogenized melt is then cast into the cavity of a metallic mold (e.g. by means of gravity casting, suction casting, spray casting or die casting) being at ambient temperature and having a desired shape. The melt solidifies within seconds in the mold.

The shape of the mold may be the desired end-form of a product which needs no further finishing treatment.

Alternatively, semi-finished parts can be fabricated, e.g. bars with rated break points, which may be transformed into rods, blocks or pellets for further use e.g. in high pressure die casting (injection molding).

The use of the pre-formed alloy L (aZr bHf cM dNb eO) has great advantages. If the components of L were employed individually, melting of the high-melting Nb would require a plasma or arc melting procedure which is much more intricate than melting in a furnace and allows only limited amounts to be processed.

Due to the stability of the undercooled liquid state against crystallization which allows slower cooling rates while still maintaining the amorphous state, (micro)mechanical parts with intricate structure which traditionally had to be manufactured by investment casting of conventional crystalline solidifying alloys, may be produced from the alloys of the invention by pressure casting of parts in series.

Bulk metallic glasses having a thickness of about 5 mm can be formed with this alloy.

The mechanical properties of the alloy of the invention are excellent. The alloy has a strength up to 2 GPa, elastic elongation of 2%, and very small damping. This is very surprising and of high advantage in view of the relatively low purity of the alloy L, in particular $L_{com}$, employed and thus the low costs of the starting materials.

EXAMPLE

To achieve a batch of the alloy with a favoured total mass of 20 g, the components L, Cu and Al were weighed according to the concentration of xL yCu zAl wherein x =71.9 wt %, y=24.4 wt %, and z=3.7 wt %. The fraction of L is given by a piece of the commercial alloy Zircadyne® R60705 (ATI Europe) with a mass of 14.4 g, Cu is given by spheres and slugs obtained from Alfa Aesar (Johnson Matthey Company, Germany) with a nominal purity of 99.99 wt % and a mass of 4.88 g, while Al is used in form of slugs obtained from Alfa Aesar (Johnson Matthey Company, Germany) with a nominal purity of 99.99 wt % and a mass of 0.748 g. All elements were cleaned subsequently in an ultrasonic bath employing ethanol.

The elements were alloyed, homogenized, and cast into a mold in an induction furnace system MC15 purchased from Indutherm GmbH, Germany. Melting and alloying of the elements was performed in a carbon crucible under purified Ar inert gas atmosphere at a pressure of 1.1 atm (1.1 bar) and was achieved within 60 sec with the power control set at 70% of the system's maximum power. Subsequent homogenization of the melt was conducted within 30 sec at a reduced power setting of 40%. The melt was then immediately poured into a mold made of Cu by tilting the system. The material solidified within 5 seconds in form of barrel-shaped pellets of 1.5 g each for the further use in die-casting.

Prototype parts were produced with complex shapes having dimensions up to 20 mm×10 mm×5 mm for the use in micromechanical applications utilizing the pellet-feedstock in a die-cast system from Nonnenmacher GmbH & Co. KG, Germany. These parts were investigated with regard to their thermophysical and microstructural properties by power-compensated differential scanning calorimetry (DSC), scanning electron microscopy (SEM), energy dispersive X-ray spectroscopy (EDX) and X-ray diffraction (XRD) analyses. SEM-micrographs and measured concentrations of elements by EDX confirmed a homogeneous material at fractions of the elements coinciding with the nominal composition within the detection limits. DSC- and XRD-data verified the amorphous nature of the castings (see FIG. 1).

The invention claimed is:

1. A bulk metallic glass forming alloy having the following composition:

$$x(a\mathrm{Zr}\ b\mathrm{Hf}\ c\mathrm{M}\ d\mathrm{Nb}\ e\mathrm{O})y\mathrm{Cu}\ z\mathrm{Al}$$

wherein

M=Fe and/or Cr, x=70.5-73.5 wt %; y=23.3-25.5 wt %; z=3.4-4.2 wt %;

with x+y+z=100%; and a=91.0-98.0 wt %; b=0.02-4.5 wt %; c=0.02-0.2 wt %; d=1.8-3.2 wt %; e=0.02-0.18 wt % with a+b+c+d+e=100 wt %, with unavoidable trace impurities not being considered.

2. The bulk metallic glass forming alloy according to claim 1, wherein x=71.9 wt %, y=24.4 wt %, and z=3.7 wt %.

3. A product manufactured using a process selected from the group consisting of gravity casting, suction casting, spray casting, die casting, high pressure die casting, and thermoplastic forming, to process the bulk glass forming alloy of claim 1.

4. A method of preparing a bulk metallic glass forming alloy having the following composition:

$$x(a\mathrm{Zr}\ b\mathrm{Hf}\ c\mathrm{M}\ d\mathrm{Nb}\ e\mathrm{O})y\mathrm{Cu}\ z\mathrm{Al}$$

wherein

M=Fe and/or Cr, x=70.5-73.5 wt %; y=23.3-25.5 wt %; z=3.4-4.2 wt %;

With x+y+z=100%; and a=91.0-98.0 wt %; b=0.02-4.5 wt %; c=0.02-0.2 wt %; d=1.8-3.2 wt %; e=0.02-0.18 wt % with a+b+c+d+e=100 wt %, with unavoidable trace impurities not being considered;

comprising providing 70.5-73.5 wt % of a pre-formed alloy L=aZr bHf cM dNb eO wherein a, b, c, d, e and M are defined above, 23.5-25.5 wt % of Cu, and 3.4-4.2 wt % of Al, heating under an inert gas atmosphere to a temperature higher than the liquidus temperature of the pre-formed alloy L, homogenizing at a temperature of about 50 to about 100 K above the liquidus temperature of the resulting alloy, and casting into a metallic mold.

5. The method of claim 4, wherein x=71.9 wt %, y=24.4 wt %, and z=3.7 wt %.

* * * * *